United States Patent [19]

Hart

[11] 3,952,342

[45] Apr. 27, 1976

[54] MULTIPURPOSE FURNITURE

[76] Inventor: James E. Hart, 1420 Harpst, Ann Arbor, Mich. 48104

[22] Filed: Jan. 27, 1975

[21] Appl. No.: 544,227

[52] U.S. Cl. ..... 5/2 R; 5/3; 5/5

[51] Int. Cl.[2] ..... A47C 13/38; A47B 81/00; 108 10;147

[58] Field of Search ..... 312/237; 5/2–8, 9, 63

[56] References Cited

UNITED STATES PATENTS

| | | | |
|---|---|---|---|
| 3,028,606 | 4/1962 | Boutet | 5/9 R |
| 3,140,559 | 7/1964 | Grow et al. | 108/10 |
| 3,337,879 | 8/1967 | Humphrey | 5/24 |
| 3,858,253 | 1/1975 | Lauzon | 5/2 R |

FOREIGN PATENTS OR APPLICATIONS

| | | | |
|---|---|---|---|
| 131,154 | 1/1949 | Australia | 5/2 R |

*Primary Examiner*—Casmir A. Nunberg
*Attorney, Agent, or Firm*—Beaman & Beaman

[57] ABSTRACT

An article of furniture basically comprising a combination bed and table, such as a drawing table. Four vertically disposed columns support a bed platform upon which a mattress may be located, and a table is supported directly above the bed platform on the columns for vertical adjustment thereon. A lamp support is mounted upon the columns directly above the table, and table vertical adjusting means in the form of a winch is mounted upon the lamp support, and through cables located within the columns provides vertical adjustment of the table. The table is mounted in guides for horizontal displacement thereof, and the table guides may be tilted to the horizontal.

9 Claims, 9 Drawing Figures

MULTIPURPOSE FURNITURE

BACKGROUND OF THE INVENTION

The invention pertains to multipurpose furniture, and in particular a combination bed, worktable, such as a drawing table, and light.

Multipurpose furniture has the advantage of saving space as well as permitting furniture to serve several purposes at a cost less than that of the cost of several pieces of functional furniture separately. However, much of the multipurpose furniture which has been designed and produced in the past is impractical for several reasons, such as bulkiness in shipping, expense of manufacture, difficulty in efficient arrangement in the occupied room and excessive compromise with respect to comfort and accessibility to the various functions of the furniture.

It is often desirable to have a large table, such as for drawing purposes, or for lightweight work purposes, such as model building, sewing, study and the like, but most households do not have the room for such a table and thus the kitchen and dining tables are often used for these types of activities. All households contain beds, and it is readily appreciated that the space above a bed is normally unused, and, in a sense "wasted", except in the case of tiered beds, commonly known as bunk beds.

It has been suggested to produce multipurpose furniture wherein a table or desk surface is used in conjunction with beds, and U.S. Pat. Nos. 1,402,432 and 3,041,633 disclose such devices. However, such patented articles of furniture have not proven practical for a number of reasons, including high cost of manufacture, and difficulty in shipping, and the prior art devices have not effectively utilized the space above a bed to receive a table which is practical and readily usable.

SUMMARY OF THE INVENTION

It is an object of the invention to provide a multipurpose furniture article which combines a bed platform, a table, such as for drawing or light work purposes, and a lamp. It is a further object of the invention to provide a combined bed, table and lamp in an article of furniture wherein the table is normally located directly above the vertical projection of the bed platform, yet the table may be horizontally displaced from such vertical alignment, and may also be tilted with respect to the horizontal.

An additional object of the invention is to provide a multipurpose furniture article supported upon four columns wherein the columns include guideways for receiving fasteners for attaching a bed platform, a worktable and a light support. The guideways include elongated channels whereby the table may be vertically adjusted, and the light support includes table adjusting means in the form of a winch having cables received within the column guideways. In this manner ready vertical adjustment of the table may be achieved and the furniture is of an attractive appearance as the table adjustment cables are not readily exteriorly visible.

In the practice of the invention the bed platform, table and light support are mounted upon extruded columns including elongated recesses or channels. Fasteners received within the column recesses attach a bed platform, table guideways and a light support to the columns. The table guideways include elongated grooves or tracks in which a table platform is slidably mounted for horizontal adjustment, and as the table guideway supports associated with the column may be released from the column the guideways may be tilted to produce a tilting of the table.

Adjacent the upper end of the columns the light support is mounted on which illuminating means, such as flourescent lamps, are mounted. Further, a threaded winch shaft is rotatably mounted on the light support having cables associated therewith extending across the light support and into the column channels for connection to the table guideways. Thus, winding of the cables upon the winch shaft will vertically raise the table guideways and table upon release of the table guideways column fasteners.

The column channels permit a variety of brackets, such as shelf brackets, to be mounted to the columns at desired vertical locations, and drawers may be incorporated into the bed platform for storage purposes.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
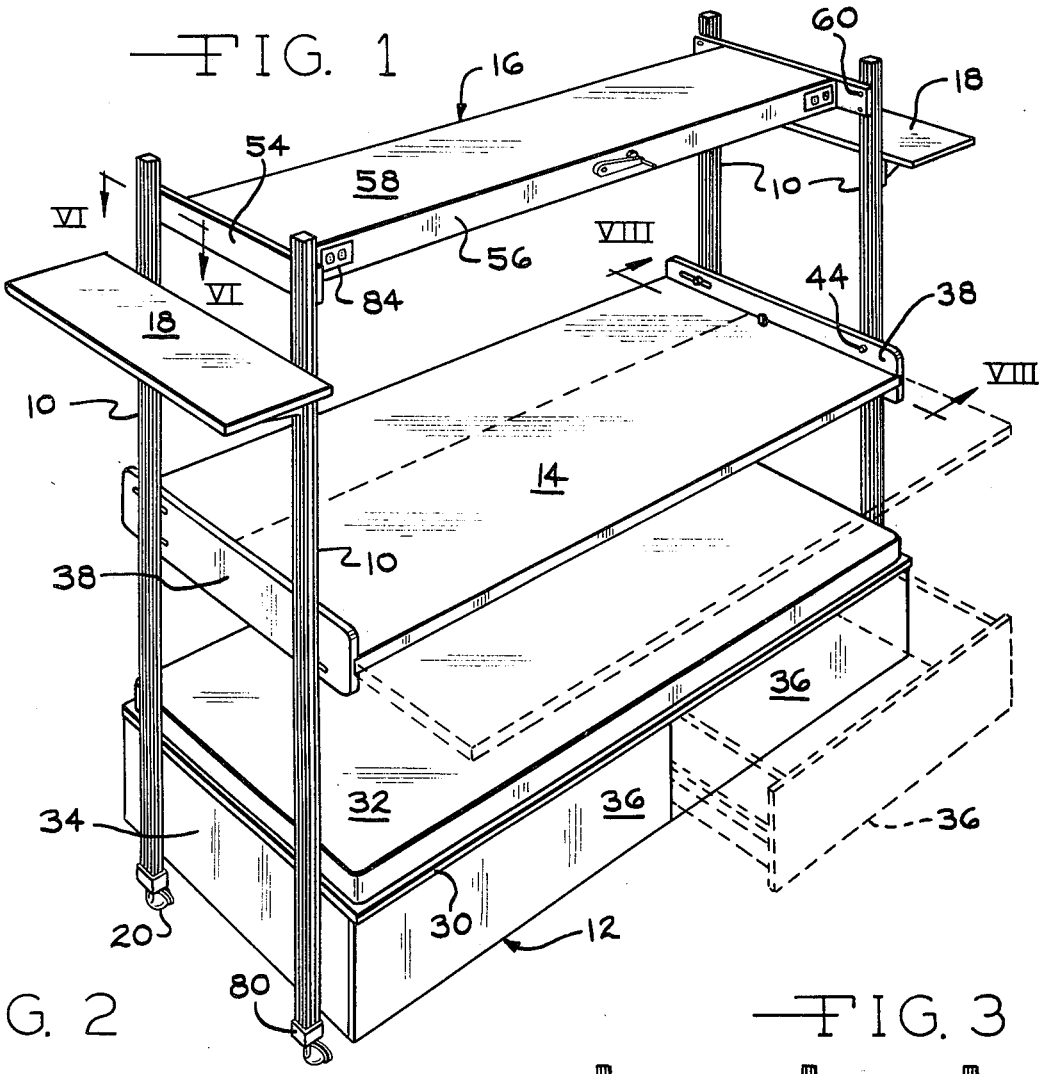
FIG. 1 is a perspective view of an article of furniture in accord with the invention, horizontal displacement of the table being shown in dotted lines, and the extension of a bed platform drawer being shown in dotted lines.
Figure 2:
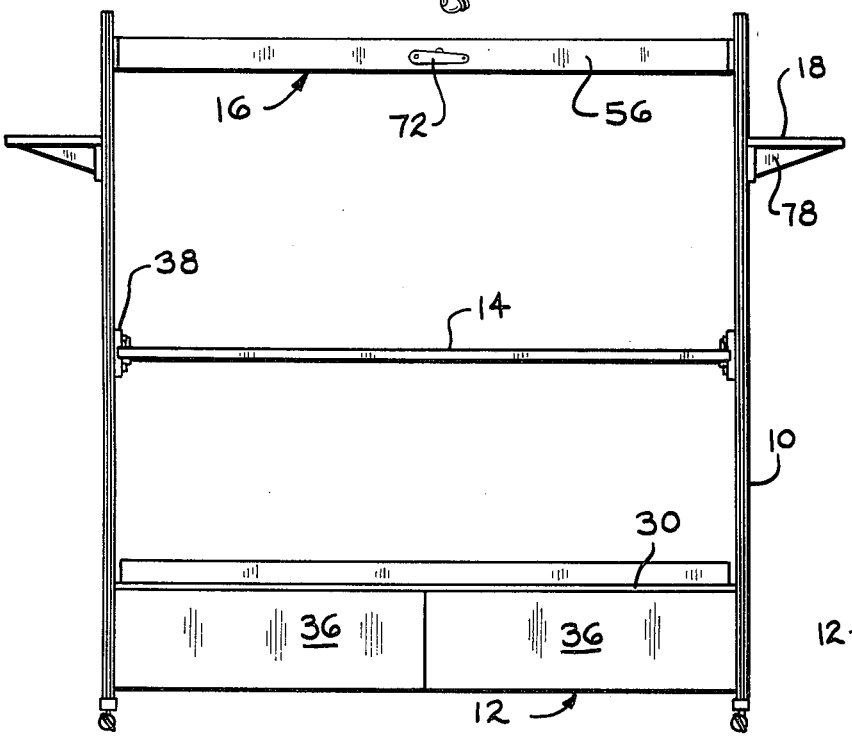
FIG. 2 is a side elevational view.
Figure 3:
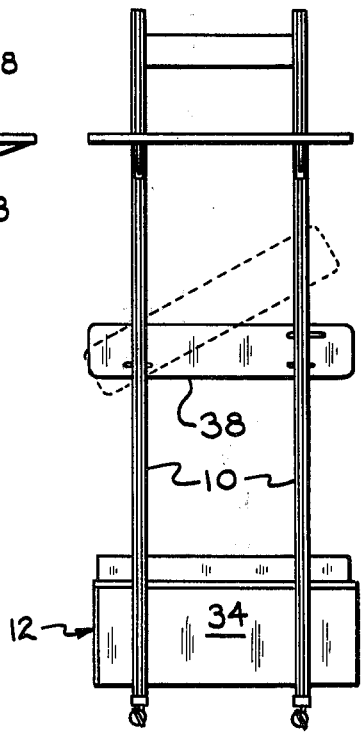
FIG. 3 is an end elevational view.

The overall appearance of multipurpose furniture in accord with the inventive concept will be appreciated from FIGS. 1 through 4. Basically, the furniture article consists of four vertical columns 10 arranged in a rectangular orientation which support a bed platform 12, a table 14, and a light support 16. The columns may also have shelves mounted thereon, and for purpose of illustration two shelves 18 are shown. Preferably, casters 20 are mounted upon the lower ends of the columns.

Figure 7:
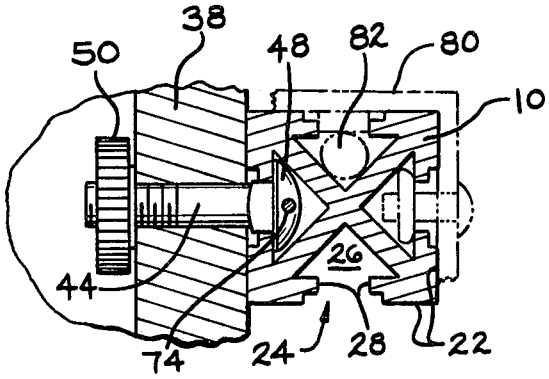
FIG. 7 is an enlarged, plan, sectional, detail view of a table guideway fastener and a column as taken along section VII—VII of FIG. 9.

The columns 10 are preferably of an extruded cross section, usually formed of aluminum, and while a number of acceptable cross-sectional configurations are available, for purpose of illustration an X type cross-sectional column is shown, FIG. 7. The columns have a generally square exterior configuration defined by flat exterior surfaces 22, and each surface is intersected by a longitudinally extending recess 24 which includes a channel 26, and shoulders 28. The recesses extend the length of the columns, and as this type of column is extruded it is available in indefinite lengths, and is relatively inexpensive.

The bed platform 12 may be of a box type configuration and includes an upper panel 30 upon which the rectangular mattress 32 rests. The bed platform includes end panels 34, which are attached to the adjacent columns 10 by bolts, not shown, wherein the head of the bolts fits into the column channels 26 and the head thereof is drawn against the shoulders 28, in a manner that will be apparent from FIG. 7. Preferably, drawers 36 are mounted within the bed platform for the storage of bedding material, or other articles. Normally, the vertical position of the bed platform on the columns is not adjusted, once determined, but it will be appreciated that the bed platform may be vertically located as desired upon the columns 10.

Figure 8:
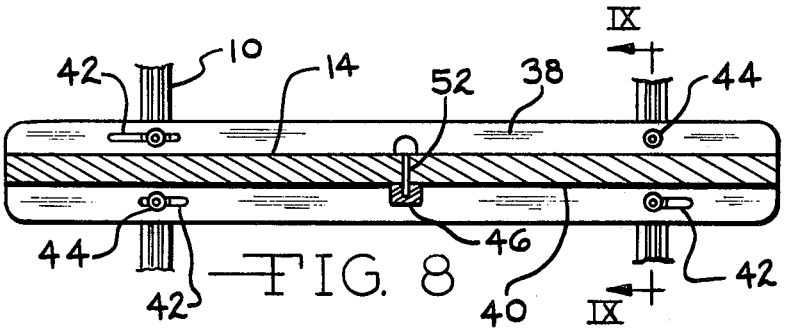
FIG. 8 is an elevational, sectional view taken through the table along section VIII—VIII of FIG. 1, and, FIG. 9 is an enlarged, elevational, detail, sectional view taken through a table guideway and column along section IX—IX of FIG. 8.
Figure 9:
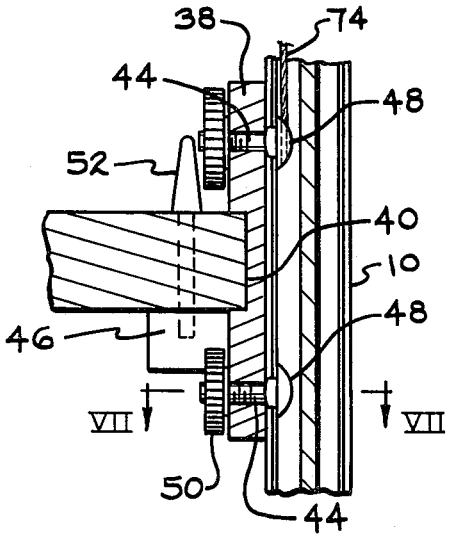

The table 14 is supported upon the columns by a pair of guideway members 38. The guideway members are of a length greater than the spacing between the end columns, and are of an elongated configuration including a recess 40 having the table received therein, as apparent in FIG. 9. The guideways 38 are provided with openings 42 through which the support bolts 44 extend, and as will be appreciated from FIG. 8, three of these openings are in the form of elongated slots to permit tilting of the guideways and the table while the unsloted opening functions as a pivot. The guideways are also provided with a detent block 46 affixed thereto immediately below the recess 40 and centrally between the guideway ends.

The bolts 44 attaching the guideways to the columns 10 include a head 48 received within a column channel for abutment against shoulders 28, and knurled nuts 50 may be readily manually tightened and untightened to lock the guideways with respect to the columns. Adjustment cables are attached to the upper bolts 44 for adjustment of the table as will be later described.

The table 14 is provided with square ends which are received within the guideway recesses 40. Thus, it will be appreciated that the table will slide within the guideways in a horizontal direction, such as shown in the full and dotted line representations of FIG. 1. The central position of the table may be locked by use of the detent 52 extending through a hole in the table and received within a hole in the detent block 46. By unloosening the nuts 50 the guideways may be tilted with respect to the columns, thereby tilting the table, and such tilting is often desired when the table is being used for drawing purposes.

Figure 4:
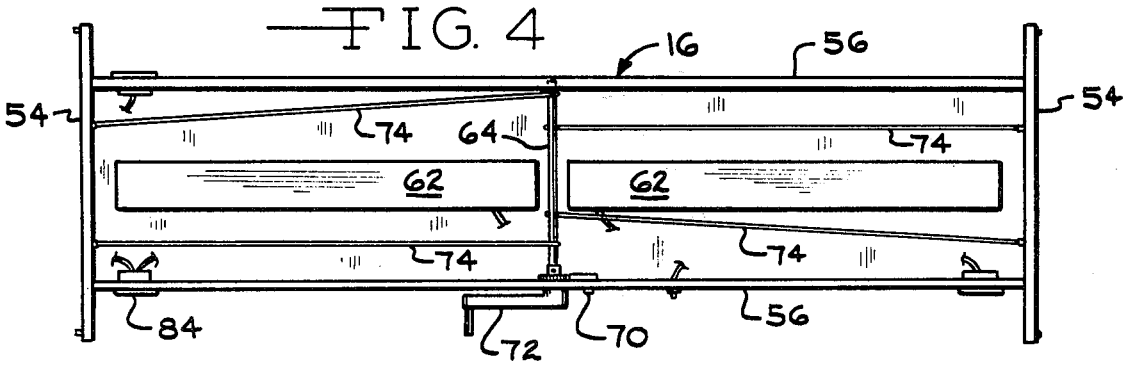
FIG. 4 is a top plan view of the light support, the light support top panel being removed for purpose of illustration.
Figure 5:
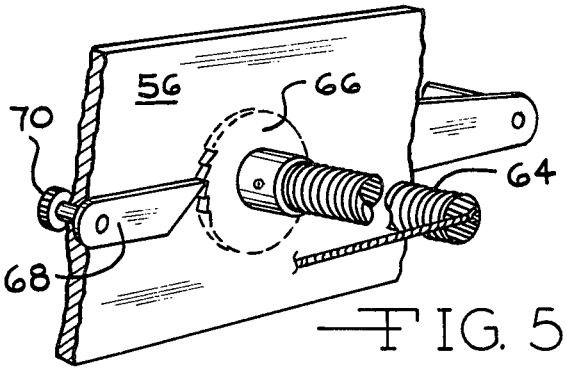
FIG. 5 is an enlarged, detail, perspective view of the winch shaft and winch catch.

The light support 16 is mounted upon the upper regions of the columns and includes end brackets 54 upon which are mounted the lateral side panels 56. A top panel 58 covers the top of the light support, and for purpose of illustration this top panel is not shown in FIG. 4. Headed bolts 60, FIG. 1, are received within the column channels in a manner similar to FIG. 7 for attaching the light support brackets 54 thereto. Fluorescent lamps 62, FIG. 4, are mounted within the light support for illuminating the upper table surface.

In order to facilitate vertical positioning of the table, a winch shaft 64 is rotatably mounted on the light support interposed between the lateral panels 56. The winch shaft is exteriorly threaded, and is provided with a ratchet wheel 66 which cooperates with a ratchet catch or dog 68 having an exteriorly accessible operating knob 70. Thus, it will be appreciated that the ratchet dog 68 may be manually operated to limit the rotation of the winch shaft to a single direction. Rotation of the winch shaft is produced by the hand crank 72.

Figure 6:
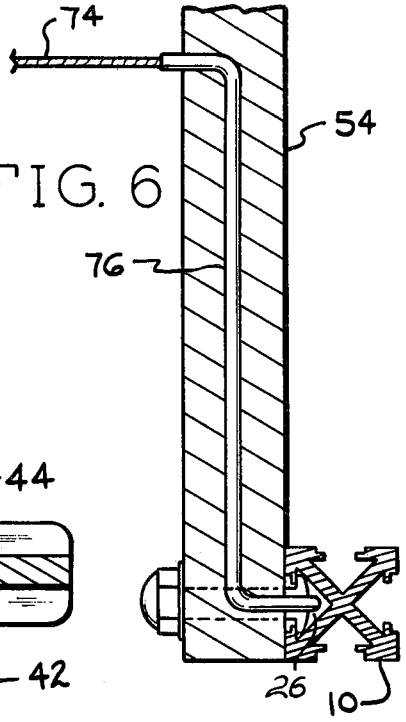
FIG. 6 is an enlarged, detail, plan, sectional view of a cable guide within the light support end bracket as taken along section VI—VI of FIG. 1.

Four flexible cables 74 have their upper ends fixed to the shaft 64 for winding thereon as the shaft is rotated. The cables enter tubular cable guides 76 located within the light support brackets 54, FIG. 6, whereby the cables are led into the column channels 26 in which the table guideway bolts 44 are located. The lower end of the cables are attached to the upper bolts 44, and will be apparent from FIGS. 7 and 9, and thus upon unloosening of the nuts 50 rotation of the shaft 64 by the crank 72 will raise the guideways 38 and table 14 supported thereon. The weight of the table is sufficient to cause the guideways and table to lower when the catch 68 is released, the nuts 50 unloosened, and the crank rotated in a direction to unwind the cable from the shaft 64.

The shaft 64 is threaded whereby the threads of the shaft function as a helical guideway for receiving the cables 74 as they are wound thereon, and thus the cable will not wind upon itself, and the normal horizontal orientation of the table will be accurately maintained during operation of the adjustment winch.

Shelf brackets 78 may be mounted on the columns 10, and are attached thereto by headed bolts similar to those shown in FIG. 7. The shelves 18 are mounted upon the brackets, and as many shelf brackets as desired may be mounted upon the columns.

Casters 20 may be attached to the lower ends of the columns 10 by means of rectangular caps 80, FIG. 7, utilized to maintain the caster stems 82 within a channel of the columns. Also, if desired, electrical outlets 84 may be incorporated into the light support panels 56, and the electrical cord supplying the light and outlets is preferably received within a column channel 26.

It will therefore be appreciated that the disclosed multipurpose furniture provides a practical combination of a bed and worktable, such as a drawing table. When the table is to be used, it may be vertically adjusted by means of the winch shaft 64 to that height most convenient for standing at the table, or sitting. Displacement of the table in the guideway recesses 40 permits the table to extend outwardly to provide sufficient leg clearance, and the table may be extended to either side of the columns. Also, maximum comfort and visibility may be achieved by tilting the table, as described above.

When it is desired to use the bed, the winch 64 may be rotated to position the table at its maximum vertical position directly below the light support 16, and this adjustment provides sufficient head clearance for access to the bed platform. The convenience of the apparatus will be appreciated from the fact that drawing equipment on the table surface, model apparatus, sewing articles, or the like, may be left on the table surface as the table is raised or lowered, and thus it is not necessary to clear the table whenever the bed is to be used, as the table merely need be raised from its normal use position, and then may be lowered when table use is resumed.

It is appreciated that various modifications to the inventive concept may be apparent to those skilled in the art without departing from the spirit and scope of the invention.

I claim:

1. Multipurpose furniture comprising a combination bed and table comprising, in combination, a plurality of spaced, substantially parallel, vertically disposed elongated columns, a bed platform mounted upon said columns and supported thereby, a substantially flat table mounted on said columns disposed vertically above said bed platform and extending thereover, adjustable means mounting said bed platform and said table upon said columns whereby said platform and table may be vertically adjustably positioned upon said columns, and vertically adjusted relative to each other.

2. In multipurpose furniture as in claim 1 wherein said columns include longitudinally disposed recesses receiving adjustable positionable fasteners for mounting said platform and table upon said columns.

3. In multipurpose furniture as in claim 1, a pair of table guideways mounted upon said columns in spaced opposed relation to each other, each guideway including a recess disposed transversely to the length of said columns, said table being slidably received within said guideways' recesses for adjustable positioning transversely to the length of said columns.

4. In multipurpose furniture as in claim 3 wherein said columns each include longitudinally extending fastener receiving recesses, releasable fasteners received within said recesses mounting said guideways upon said columns whereby said fasteners and guideways are vertically adjustable upon said columns, and slots defined in said guideways receiving said fasteners permitting said guideways to be angularly adjusted relative to said columns.

5. In multipurpose furniture as in claim 1, a light support mounted upon said columns and extending therebetween vertically above said table and extending thereover, and an electric light mounted upon said support for illuminating said table.

6. In multipurpose furniture as in claim 5, elongated longitudinally extending channels defined in said columns, guide means supporting said table upon said columns and received within said channels whereby said table may be vertically adjustably displaced upon said columns, and table adjusting means mounted upon said light support operatively connected to said table for raising and lowering said table upon said columns.

7. In multipurpose furniture as in claim 6 wherein said table adjusting means comprises a winch shaft rotatably mounted upon said light support, a plurality of cables attached to said shaft adapted to be wound thereon and attached to said table, and releasable catch means selectively operatively connected to said shaft permitting unidirectional rotation thereof.

8. In multipurpose furniture as in claim 7 wherein said cables are received within said channels.

9. In multipurpose furniture as in claim 7 wherein said winch shaft is threaded on its exterior surface, said cables being received on said shaft threads during winding of said cables thereon and helically oriented on said shaft.

* * * * *